US007293684B1

(12) United States Patent
Wen

(10) Patent No.: US 7,293,684 B1
(45) Date of Patent: Nov. 13, 2007

(54) PNEUMATIC NAIL GUN

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/614,066

(22) Filed: Dec. 20, 2006

(30) Foreign Application Priority Data

Nov. 14, 2006 (TW) ..... 95142058 A

(51) Int. Cl.
*B25C 1/04* (2006.01)

(52) U.S. Cl. ..... 227/130; 227/8; 123/46 SC

(58) Field of Classification Search ..... 227/130, 227/8, 10; 123/46 SC
See application file for complete search history.

(56) References Cited

U.S. PATENT DOCUMENTS 4,294,391 A 10/1981 Obergfell
4,319,705 A 3/1982 Geist et al.
4,784,308 A 11/1988 Novak et al.
5,135,152 A * 8/1992 Uno et al. ..... 227/116
5,441,192 A * 8/1995 Sugita et al. ..... 227/130
5,485,946 A * 1/1996 Jankel ..... 227/8
5,873,510 A * 2/1999 Hirai et al. ..... 227/130
5,911,351 A * 6/1999 White ..... 227/130
6,006,975 A * 12/1999 Ishizawa ..... 227/119
6,260,519 B1 * 7/2001 Phillips ..... 123/46 R
6,533,156 B1 * 3/2003 Chang ..... 227/130
6,779,699 B2 * 8/2004 Aoki et al. ..... 227/130
7,014,089 B2 * 3/2006 Ishizawa et al. ..... 227/130
7,040,521 B2 * 5/2006 Kolodziej et al. ..... 227/10
7,118,018 B2 * 10/2006 Turk ..... 227/10

* cited by examiner

*Primary Examiner*—Scott A. Smith

(57) ABSTRACT

A pneumatic nail gun includes a gun body with a trigger, collecting a compressed high pressure air with a constant pressure, a movable cylinder installed in the gun body, a hitting piston disposed in the cylinder, a valve ring formed outside the cylinder, a head valve disposed on the top of the cylinder, at least one return passage formed outside the cylinder, and a valve bolt disposed in the return passage. Before the trigger is pressed, the high pressure air drives the valve ring to keep the cylinder at the upper position to close the head valve. When the trigger is pressed, the high pressure air drives the cylinder move downwardly to open the head valve for guiding the high pressure air to drive the piston downwardly move to hit nails. When the trigger is released, the high pressure air drives the valve bolt open for guiding the high pressure air via the return passage to drive the piston rapidly move upwardly to reposit.

17 Claims, 8 Drawing Sheets

PNEUMATIC NAIL GUN

BACKGROUND

The present invention relates to pneumatic nail guns, and particularly to a pneumatic nail gun having a movable cylinder for a hitting piston of the nail gun driven by the high pressure air to upwardly move for reposition and a head valve disposed on top of the movable cylinder.

A typical pneumatic nail gun has a gun body, a main air housing formed in the gun body to continuously collect the compressed high pressure air for nail hitting, a movable or fixed cylinder disposed in the gun body, and a hitting piston installed inside the cylinder and divided the cylinder into a top and a bottom cylinder chambers. Moreover, a trigger disposed on the gun body may be pressed to have the high pressure air guided into the top cylinder chamber to drive the piston downwardly move for hitting the nails, and be released to have the high pressure air discharged from the top cylinder chamber and guided into the bottom cylinder chamber to upwardly move the piston for reposition.

The related arts, such as U.S. Pat. No. 4,784,308, U.S. Pat. No. 4,319,705 and U.S. Pat. No. 4,294,391 respectively disclose a pneumatic nail gun having the movable cylinder and the head valve individually disposed on top of the movable cylinder. The head valve can push the cylinder moving downwardly and move upwardly together with the cylinder. When the trigger is pressed, the high pressure air in the main air housing can drive the head valve upwardly move together with the cylinder to open a bottom passage for air discharging in the bottom cylinder chamber and open the passage between the head valve and the cylinder to guide the high pressure air into the top cylinder chamber for driving the piston move downwardly. When the trigger is released, the cylinder moves downwardly together with the head valve to open a top passage for air discharging in the top cylinder chamber so that the piston can move upwardly to reposit. However, since the head valve is separated from the cylinder, in order to effectively control the head valve and the cylinder moving together, not only a passage for moving the head valve has to be formed in the gun body, but also a passage for the high pressure air moving the cylinder has to be formed in the main air housing. As such, the nail gun has a high manufacturing cost and complicated air flow passage distribution.

Above related arts also disclose to utilize a valve control device between the main air housing and the bottom cylinder chamber to control the timing of the high pressure air driving the piston move upwardly to reposit; therefore, as the trigger is released, the valve control device can open the passage between the main air housing and the bottom cylinder chamber so that the high pressure air can be continuously introduced to the bottom cylinder chamber to move the piston upwardly for reposition. However, the valve control device has complicate assembly and more passages in the nail gun are needed, as well as the valve control device is installed farther away from the cylinder in the gun body so that larger capacity of gun body and higher cost are inevitable.

Accordingly, what is needed is a pneumatic nail gun that can overcome the above-described deficiencies.

BRIEF SUMMARY

A pneumatic nail gun of the present invention improves the air flow passage distribution for the compressed high pressure air driving the piston upwardly move to reposit and simplifies the valve controlling mechanism required by the distribution; therefore, the manufacturing cost can be reduced.

The present invention is to provide a pneumatic nail gun includes a gun body having a movable cylinder installed therein, a hitting piston disposed in the cylinder to divide the cylinder into a top cylinder chamber and a bottom cylinder chamber, a main air housing formed in the gun body for accumulating compressed air at a high pressure, a trigger valve being disposed at one end of the main air housing to be driven by a trigger disposed on the gun body to drive the hitting piston downwardly move to hit nails and upwardly move to reposit.

A head valve is disposed on the top of the cylinder. A valve ring is disposed on the outer wall of the cylinder so that a middle chamber is formed between the valve ring and the inner wall of the gun body to accumulate high pressure air therein. Before the trigger is pressed, the high pressure air push the cylinder moving upwardly to make the head valve close air communication between the main air housing and the top cylinder chamber. When the trigger is pressed, the middle chamber discharges air and the cylinder moves downwardly driven by the high pressure air in the main air housing to make the head valve open the air communication between the main air housing and the top cylinder chamber so as to guide the high pressure air driving the piston downwardly move to hit nails. As such, the complexities of chamber and passage design for the high pressure air in the gun body to drive the cylinder downwardly move to open valves and upwardly to close valves can be simplified.

A return passage is formed on the outer wall of the cylinder to drive the piston upwardly move for reposition, which is connected between the main air housing and the bottom cylinder chamber. As such, the return passage can provides the shorter distance connected between the main air housing and the bottom cylinder chamber to simplify the air passage.

The return passage includes a valve bolt therein. When the trigger is released, the valve bolt is driven by the high pressure air to open the return valve opening so that the high pressure air in the main air housing is guided to the bottom cylinder chamber to continuously drive the piston rapidly move upwardly for reposition. As such, conventional valve controlling device is improved

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
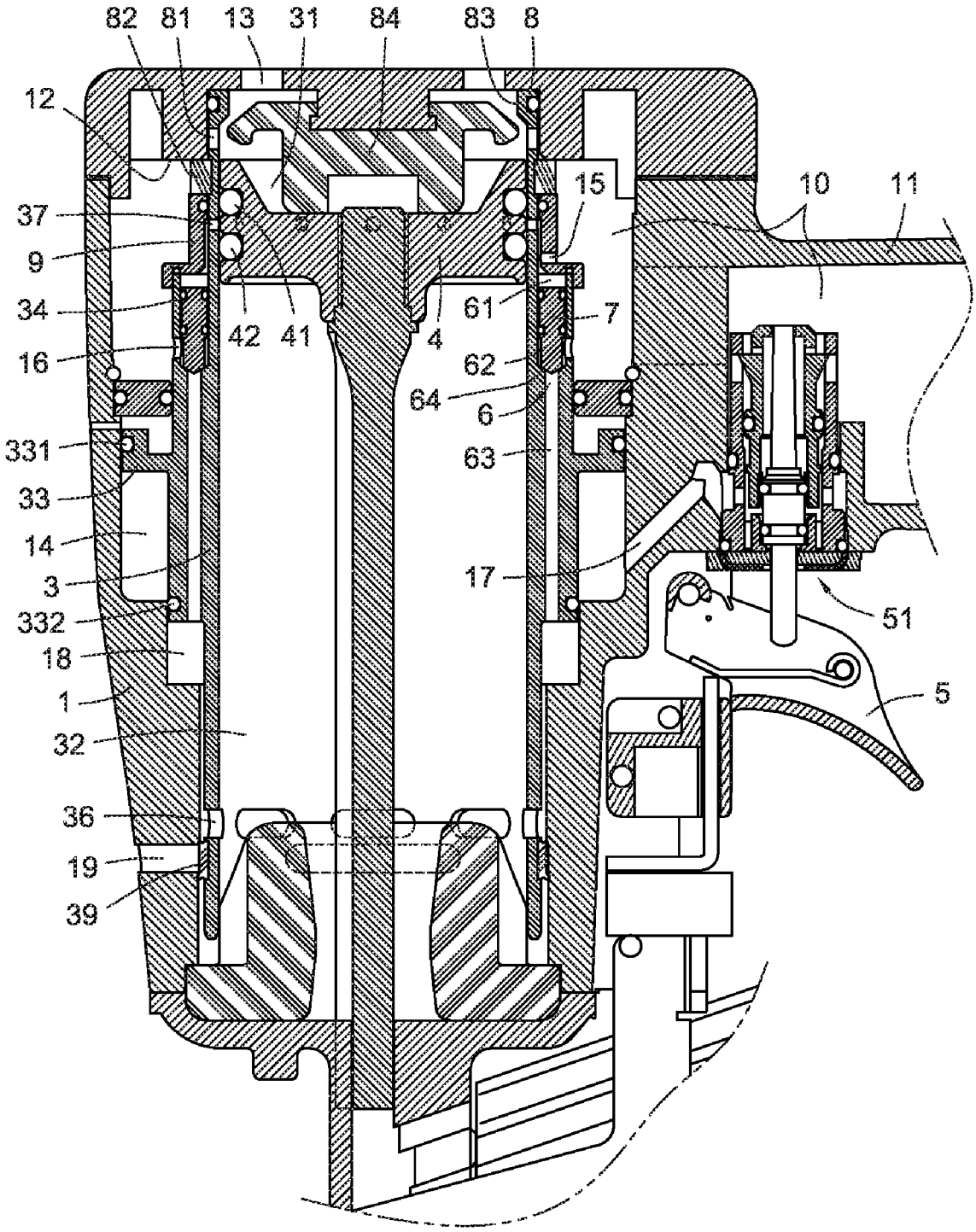
FIG. 1 is a side, cross-sectional view of part of a pneumatical nail gun according to a preferred embodiment of the present invention.

Referring to FIG. 1, a pneumatic nail gun according to a first embodiment of the present invention is shown. The pneumatic nail gun has a gun body 1, a movable cylinder 3 installed in the gun body 1, a hitting piston 4 disposed in the movable cylinder 3, a main air housing 10 formed in the nail gun. The hitting piston 4 includes at least two air tight rings 41 and 42, which can divide the cylinder 3 into a top cylinder chamber 31 and a bottom cylinder chamber 32 when the hitting piston 4 move downward to hit nails or move upward to reposit. The main air housing 10 is disposed between a handle 11 of the nail gun and the peripheral portion of the cylinder 3 for continuously gathering high pressure air from air supply via a free end of the handle 11 to maintain a constant air pressure therein (see dots area in FIG. 3). A trigger valve 51 is disposed at one end of the main air housing 10 to be driven by a trigger 5 disposed on the gun body 1 for opening and closing air communication through a trigger passage 17 in the gun body 1 to the main air housing 10 in the handle 11.

A head valve 8 is integrally formed on top of the movable cylinder 3 (shown in FIGS. 1 and 2*a*) with a main valve opening 81 and an air tight ring 82 disposed thereon. Moreover, an annular rib 83 is formed inside the head valve 8 at top. The gun body 1 has a buffer pad 84 disposed in the top portion and a top exhausting hole 13 formed on the top surface for connecting with the atmosphere. Before the cylinder 3 downwardly moves (shown in FIG. 3), the air tight ring 82 is closely attached on an annular rib wall 12 which is formed in the gun body 1 to close the air communication between the main air housing 10 and the top cylinder chamber via the main valve opening 81, and the annular rib 83 opens the air communication through the top exhausting hole 13 for discharging high pressure air in the top cylinder chamber 31. When the cylinder downwardly moves (shown in FIG. 4), the air tight ring 82 is away from the annular rib wall 12 to open the air communication via the main valve opening 81, and the annular rib 83 contacts on the buffer pad 84 to close the air communication through the top exhausting hole 13.

Figure 2A:
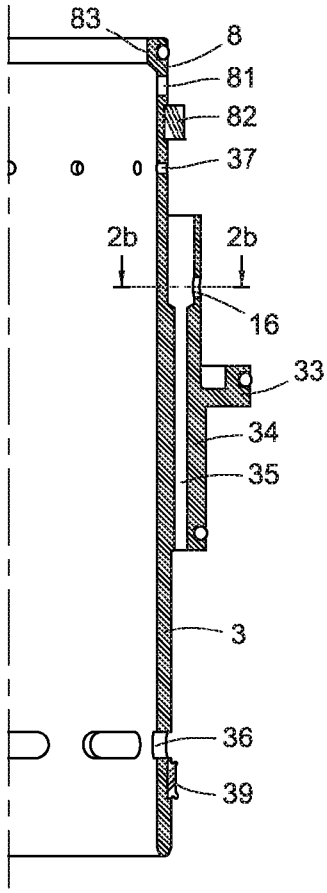
FIGS. 2*a* to 2*h* are enlarged, cross-sectional view of elements of the pneumatical nail gun of FIG. 1, showing the matching relationship therebetween.
Figure 2B:
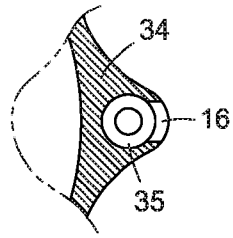

The cylinder 3 has a valve ring 33 (shown in FIGS. 1 and 2*d*) formed on the outer wall. At least two air tight rings 331 and 332 are respectively disposed between the inner wall of the gun body 1 and the valve ring 33 and the outer wall of the cylinder 3 so that a middle chamber 14 is formed in the gun body 1. Before the trigger is pressed, the middle chamber 14 can accumulate the high pressure air from the main air housing 10 through the trigger valve 51 and the trigger passage 17. The valve ring 33 has a push surface with an area A2 exposed in the middle chamber 14.

A return passage 6 is formed on the outer wall of the cylinder to drive the piston 4 upwardly move for reposition. There may be a plurality of return passages 6 connected between the main air housing 10 and the bottom cylinder chamber 32, each of which includes a valve bolt 7 (shown in FIG. 2*c*) therein. There at least one air tight ring 71 or 72 engaged with the valve bolt 7 to divide the return passage 6 into a top passage 61, a middle valve chamber 62, and a bottom passage 63. The top passage 61 is connected with the main air housing 10 via a top through hole 15 formed beside the cylinder 3 for guiding the high pressure air into the top passage 61 for accumulation, the middle valve chamber 62 is connected with the main air housing 10 via a bottom through hole 16 beside the cylinder 3 for guiding the high pressure air into the middle valve chamber 62 for accumulation. The middle valve chamber 62 is connected with the bottom passage 63 via a return valve opening 64. The valve bolt 7 has a push surface 73 with an area A3 exposed in the top passage 61 and a push surface 74 with an area A4 exposed in the middle valve chamber 62, and A3 is larger than A4. The valve bolt 7 is capable of opening and closing the return valve opening 64, and the bottom passage 63 is connected to the bottom cylinder chamber 32. When the trigger 5 is released, the valve bolt 7 is driven by the high pressure air to open the return valve opening 64 (shown in FIG. 6) so that the high pressure air in the main air housing 10 is guided to the bottom cylinder chamber 32 via the bottom through hole 16, the return valve opening 64 and the bottom passage 63 to continuously drive the piston 4 rapidly move upwardly for reposition.

Figure 2C:
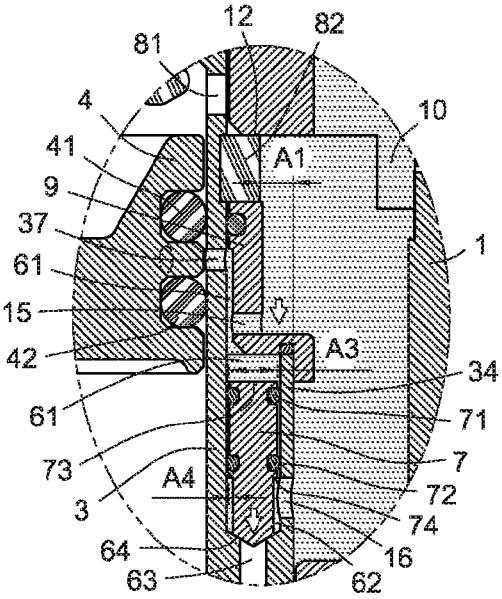
Figure 2D:
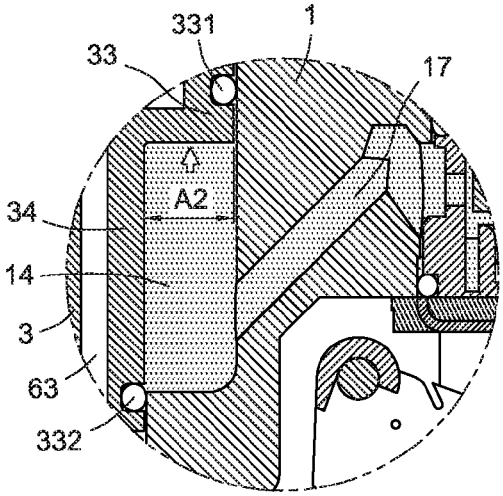

The cylinder 3 further includes at least one ear portion 34 (shown in FIGS. 2*a* and 2*b*), the ear portion 34 includes at least one ear hole 35, and an annular cover 9 is covered on the top of the ear portion 34 (shown in FIG. 2*c*). The return passage 6 may be formed between the area surrounded by the ear hole 35 and the annular cover 9 and the top passage 61 may be formed in the area surrounded between in the ear hole 35 at the top of the valve bolt 7 and the annular cover 9. The top through hole 15 may be disposed on the annular cover 9 or the ear portion 34, the bottom through hole 16 may be disposed on the ear portion 34, and the valve ring 33 may be deposed on the ear portion 34 and extending around the cylinder 3.

The annular cover 9 has a push surface with an area A1 (shown in FIG. 2*c*) exposed in the main air housing 10, which is smaller than A2 (shown in FIG. 2*d*) of the valve ring 33. Therefore, before the trigger 5 is pressed, the high pressure air in the middle chamber 14 can push the cylinder 3 moving upwardly (referring to FIG. 3) to make the head valve 8 close the air communication between the main air housing 10 and the top cylinder chamber 31; when the trigger 5 is pressed, the middle chamber 14 discharges air (referring to FIG. 4) and the cylinder 3 moves downwardly driven by the high pressure air in the main air housing 10 to make the head valve 8 open the air communication between the main air housing and the top cylinder chamber 31, so as to guide the high pressure air driving the piston downwardly move to hit nails.

The cylinder 3 further includes at least one top valve hole 37 (shown in FIGS. 1 and 2*a*) connecting with the top passage 61 and connecting with the main air housing 10 via the top passage 61 and the top through hole 15. The air tight rings 41 and 42 may be used for controlling the opening and closing of the top valve hole 37 (shown in FIGS. 3 and 4) so as to control the fluid communication between the top passage 61 and the top cylinder chamber 31. The head valve 8 can thus control the timing of the high pressure air in the main air housing 10 going through the top valve hole 37 to the top cylinder chamber 31 for driving the piston 4 downwardly move to hit the nails.

Figure 2E:
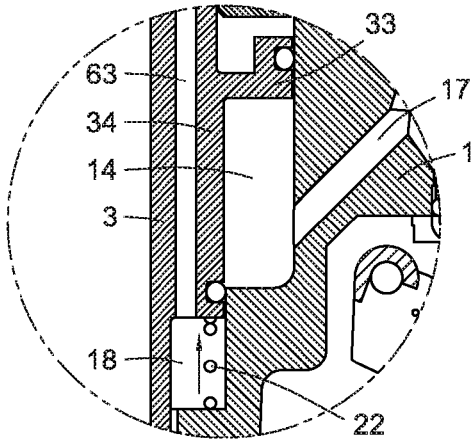
Figure 2F:
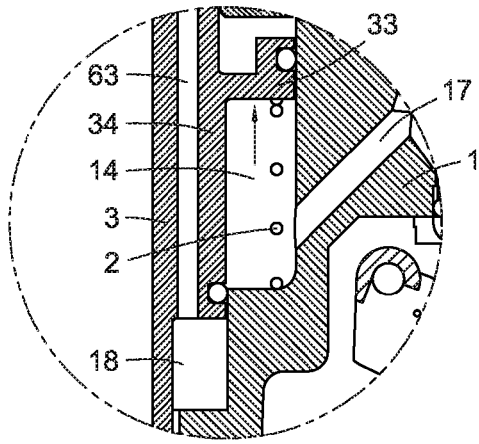
Figure 2G:
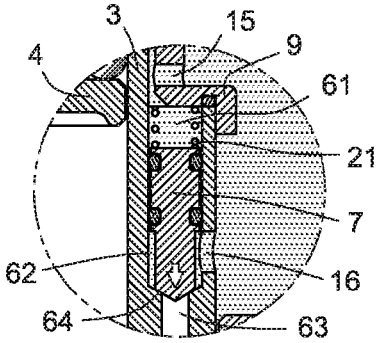
Figure 2H:
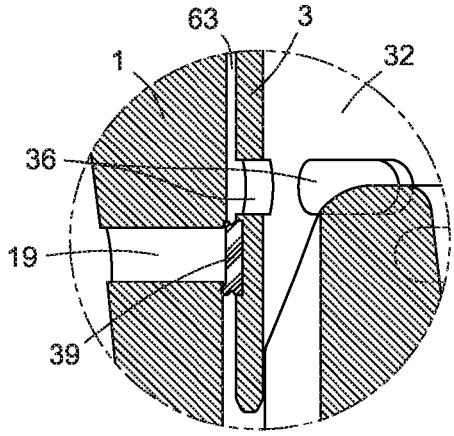

The cylinder 3 further includes at least one bottom valve hole 36 on the lower portion (shown in FIGS. 1 and 2*a*). The bottom passage 63 may connect to the bottom cylinder chamber 32 via the bottom valve hole 36, or via a lower chamber 18 formed between the inner wall of the gun body 1 and the outer wall of the cylinder 3 and the bottom valve hole 36. An air tight ring 39 is disposed on the outer wall of the cylinder 3 near the bottom valve hole 36 and a bottom exhausting hole 19 formed in the gun body 1 is for connecting to the atmosphere (referring together to FIG. 2*h*). The air tight ring 39 can close the air communication from the bottom cylinder chamber 32 to the bottom exhausting hole 19 through the bottom valve hole 36 (referring to FIG. 3) before the cylinder 3 moves downwardly, and after the cylinder moves downwardly (shown in FIG. 4), the high pressure air in the bottom cylinder chamber 32 can be discharged.

Furthermore, before driving the nail hitting operation, a spring 22 (shown in FIG. 2*e*) may be installed in the lower chamber 18, or a spring 2 (shown in FIG. 2*f*) may be installed in the middle chamber 14 to assist the high pressure air in the middle chamber 14 pushing the cylinder 3 in order to keep the cylinder 3 in the upper position. Meanwhile, the pushing force of the spring 2 or 22 is less than that of the high pressure air in the main air housing 10 to drive the cylinder 3 move downwardly.

In addition, during the trigger 5 is pressed to drive the nail hitting operation, a spring 21 (shown in FIG. 2*g*) may be installed in the top passage 62 to assist the high pressure air in the top passage 62 pushing the valve bolt 7 in order to keep the valve bolt 7 to close the return valve opening 64. Meanwhile, the pushing force of the spring 21 is less than that of the high pressure air in the middle chamber 62 to drive the valve bolt move upwardly to open the return valve opening 64.

Figure 3:
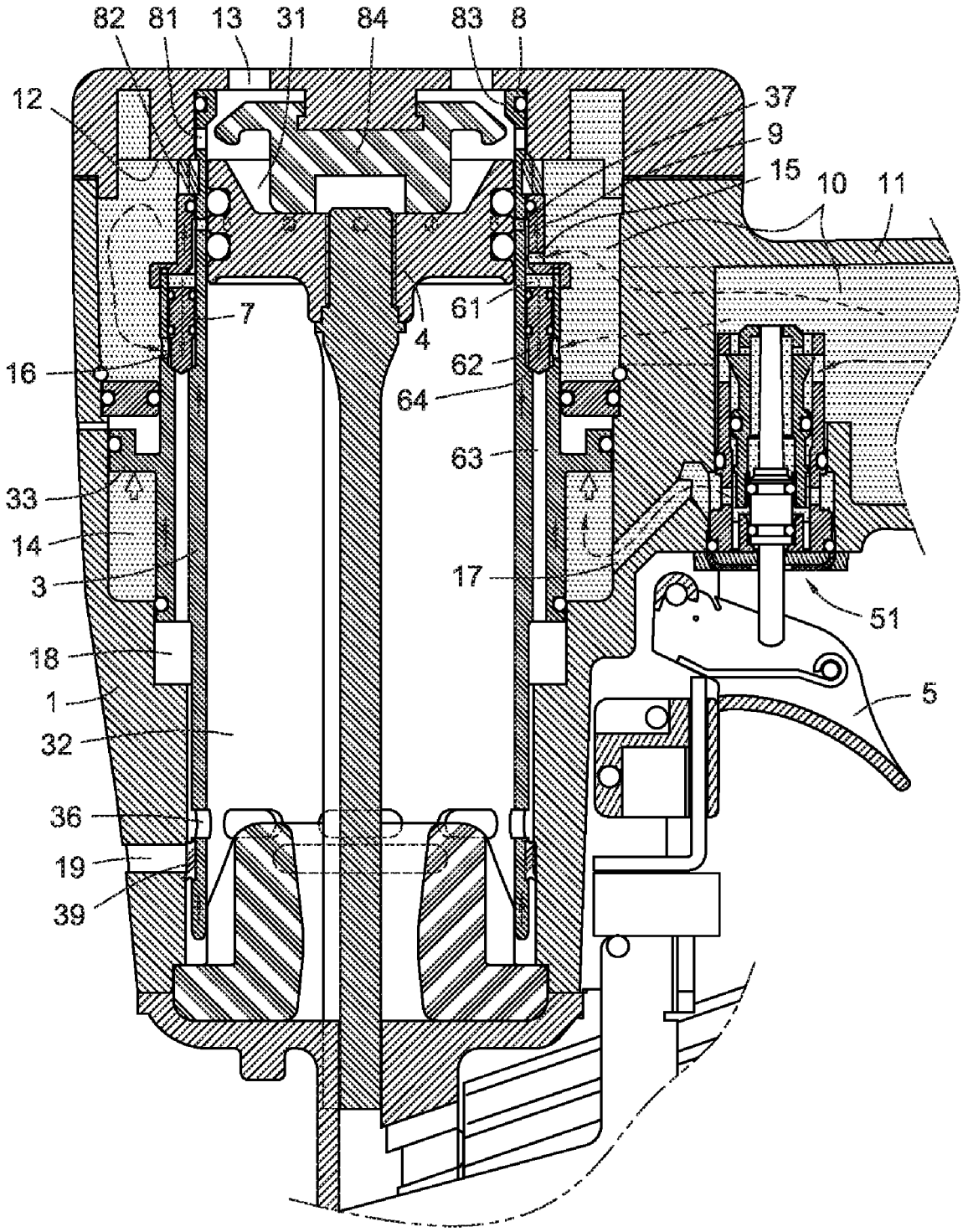
FIG. 3 is a cross-sectional view of the pneumatical nail gun of FIG. 1, showing a state of high pressure air gathered in a gun body before a trigger is pressed.

In operation, before the trigger 5 is manipulated as shown in FIG. 3, high pressure air in the main air housing 10 is applied to the annular cover 9 and to be guided into the middle chamber 14 for accumulation through the trigger valve 51 and the trigger passage 17 to push on the valve ring 33. Due to the area A1 of the annular cover 9 is less than the area A2 of the valve ring 33 (referring FIGS. 2*c* and 2*d*), the high pressure air will drive the cylinder 3 and the head valve 8 together at the upper position to close the air communication between the top cylinder chamber 31 and the main air housing 10, the air tight ring 39 closes the air communication from the bottom cylinder chamber 32 to the bottom exhausting hole 19, and the top exhausting hole 13 is opened to make the top cylinder chamber 31 connect with the atmosphere. Meanwhile, the high pressure air is guided into the top passage and the middle valve chamber 62 through the top through hole 15 and the bottom through hole 16 for accumulation. Due to the area A3 of surface 73 is larger than the area A4 of the surface 74, the valve bolt 7 is pushed down by the high pressure air to close the main valve opening 64 so that the air communication between the middle valve chamber 62 and the bottom passage 63 is closed. The hitting piston 4 closes the top valve hole 37 to prevent the high pressure air in the top passage 61 from flowing into the top cylinder chamber 31 or the bottom cylinder chamber 32.

Figure 4:
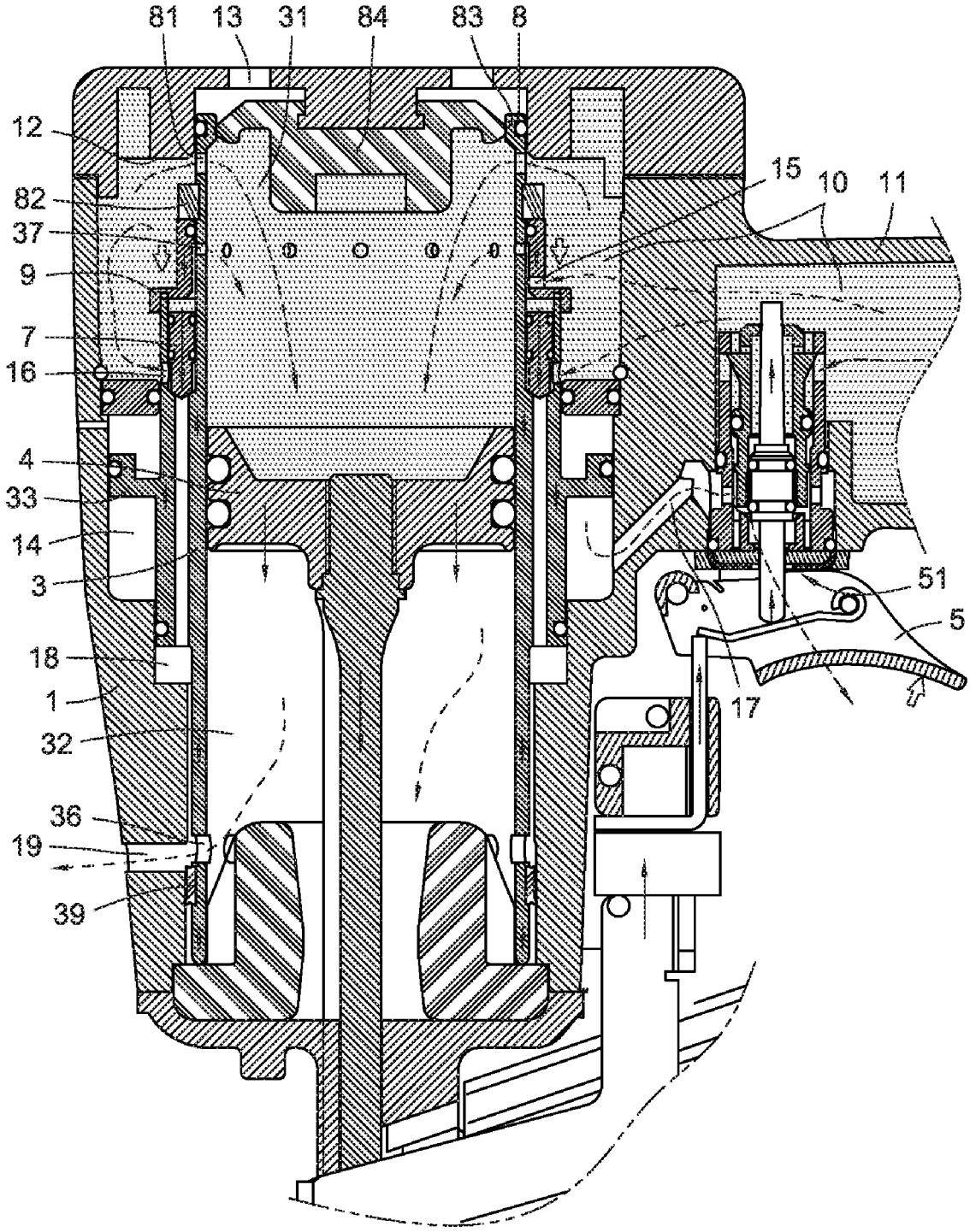
FIG. 4 is a cross-sectional view of the pneumatical nail gun of FIG. 3, showing a state of the high pressure air driving a cylinder downwardly move and then a piston downwardly move to hit nails when a trigger is pressed.
Figure 5:
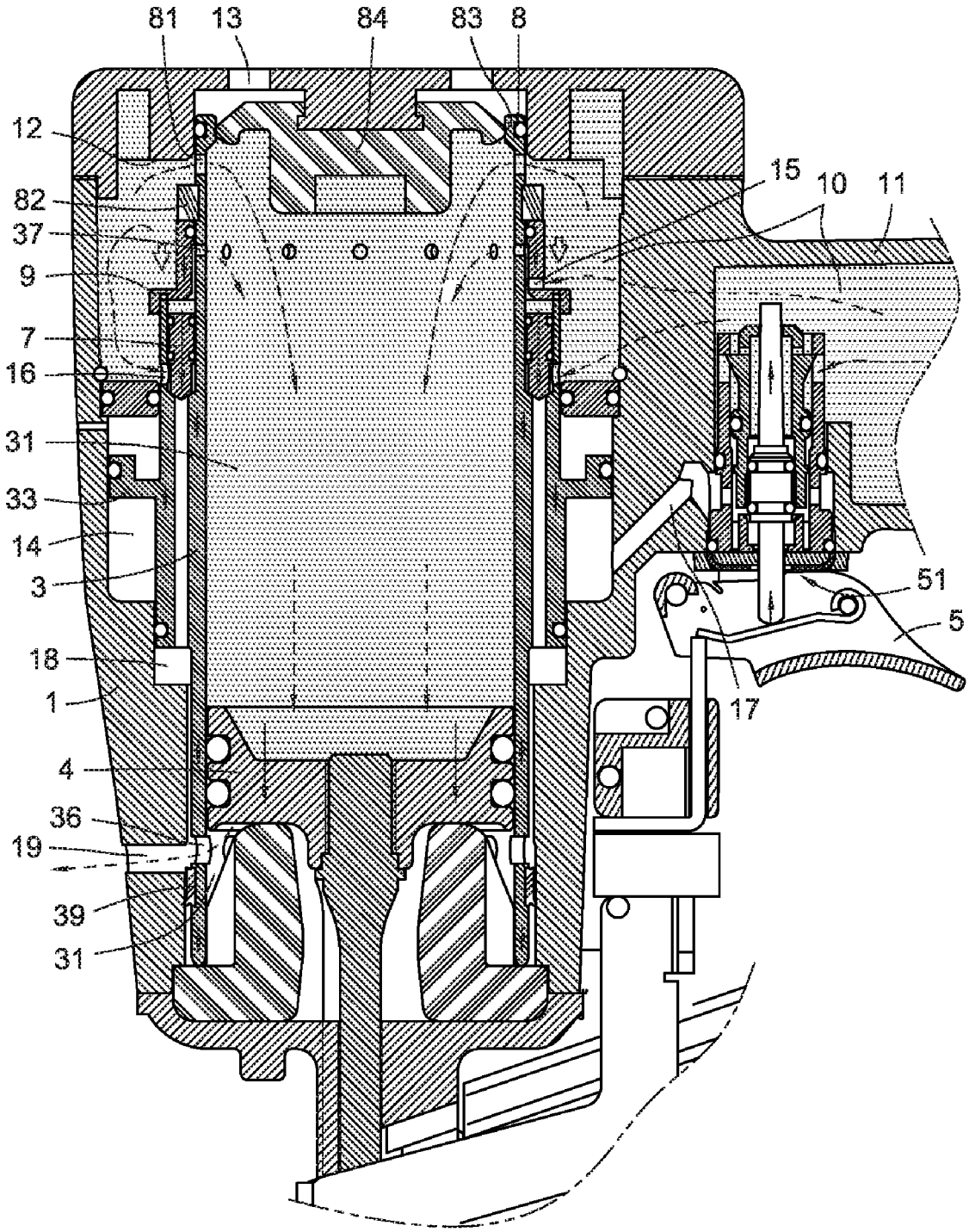
FIG. 5 is cross-sectional view of the pneumatical nail gun of FIG. 4, showing a state of the hitting piston moving to a lower end after the trigger is pressed.

When the trigger 5 is pressed as shown in FIGS. 4 and 5, the trigger valve 51 closes the air communication between the main air housing 10 and the trigger passage 17, and the trigger passage 17 is connected to the atmosphere. Compressed high pressure air in the middle chamber 14 is discharged to the atmosphere, so that high pressure air in the main air housing 10 drives the annular cover 9 to have the cylinder 3 and the head valve 8 downwardly move to open the air communication between the top cylinder chamber 31 and the main air housing 10 and close the air communication from the top cylinder chamber 31 to the top exhausting hole 13, and continuously introduce high pressure air from the main air housing 10 into the top cylinder chamber 31 for driving the hitting piston 4 rapidly downwardly move to hit nails. Moreover, the air tight ring 39 moves down to open the air communication from the bottom cylinder chamber 32 to the bottom exhausting hole 19 for discharging air in the bottom cylinder chamber 32. Meanwhile, during the press of hitting nails, the top valve hole 37 is opened and the high pressure air in the top passage 61 is continuously introduced into the top cylinder chamber 31.

Figure 6:
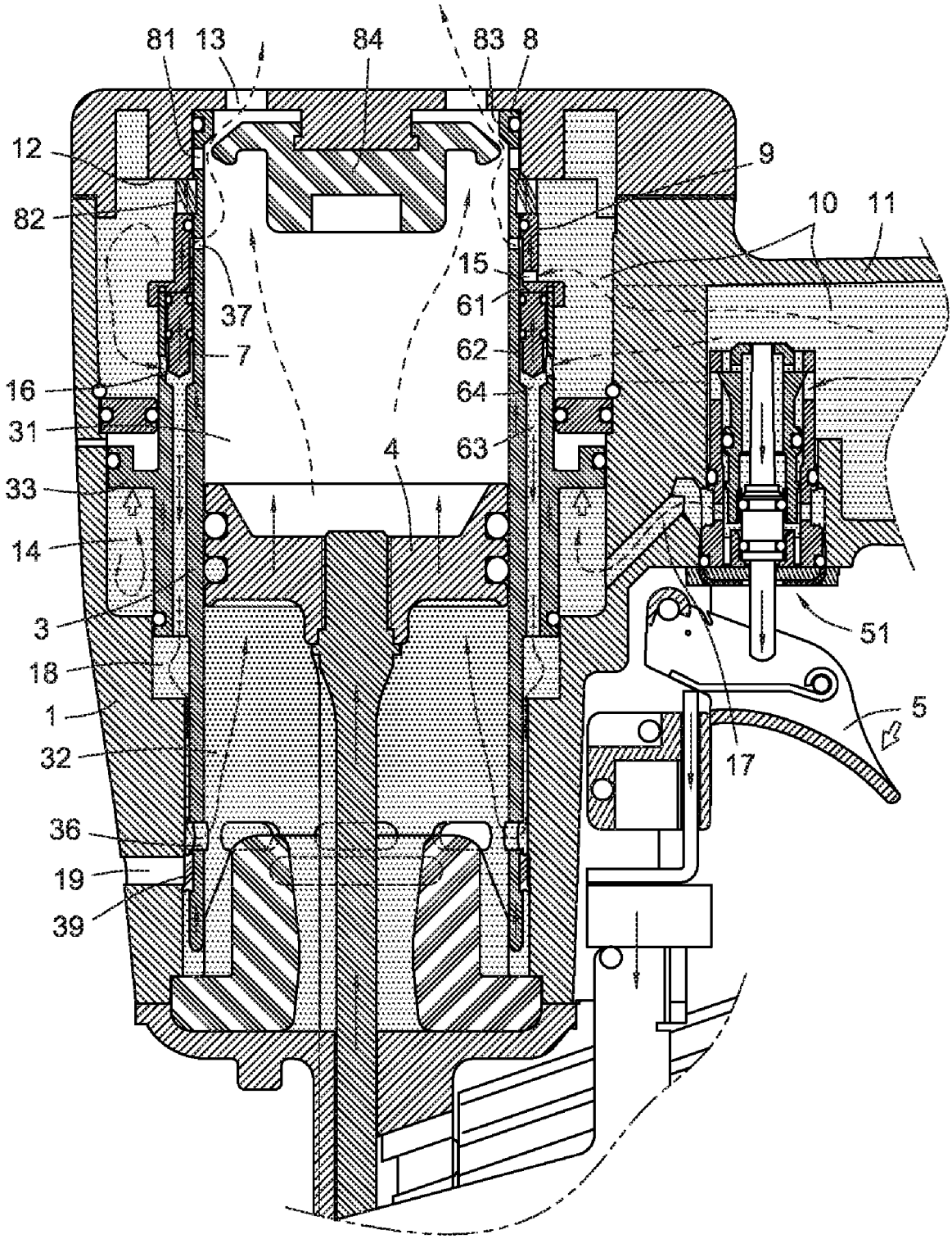
FIG. 6 is a cross-sectional view of the pneumatical nail gun of FIG. 5, showing a state after the trigger is released, the high pressure air drives the cylinder upwardly move and then a piston upwardly move to reposit.

Then, when the user releases the trigger 5 as shown in FIG. 6, that is the piston 4 hit the nails but not yet reposits, the high pressure air is guided into the middle chamber 14 to drive the cylinder 3 and the head valve upwardly move to open the air flow passage of the top exhausting hole 13 and to close the air flow passage of the bottom exhausting hole 19. The compressed high pressure air in the top cylinder chamber 31 and the top passage 61 may discharge to atmosphere via the top valve hole 37 and the top exhausting hole 13, then the high pressure air in the middle valve chamber 62 drives the valve bolt 7 upwardly move to open the return valve opening 64. The high pressure air in the main air housing 10 is guided into the bottom cylinder chamber 32 via the bottom through hole 16, the middle valve chamber 62, the bottom passage 63 and the lower chamber 18 for rapidly and stably driving the hitting piston 4 upwardly move.

When the hitting piston 4 is reposited, the top valve hole 37 is closed for continuously guiding the high pressure air in the main air housing 10 to gather into the top passage 61, so as to directly drive the valve bolt 7 downwardly move to close the return valve opening 64. The trigger 5 is reposited, thus a single shot cycle is terminated.

Therefore, from above description, the pneumatic nail gun of the present invention utilizes the return passage 6 and valve bolt 7 disposed therein to improve conventional problem of complicated valve controlling device and air flow passage distribution so that the return passage 6 for repositing the piston is simplified to ensure the nail gun having a lower cost.

Furthermore, the valve bolt 7 has a small size and a simple structure, which may be made of light material. Then the valve bolt is relatively sensitive to be driven by the high pressure air. When the top passage 61 contains the high pressure air pushing on the valve bolt to close the return valve, if the nail gun is dropped down by carelessness, the valve bolt is more reliable not to open the return valve; therefore, a higher valve controlling capability is obtained.

On the other hand, the head valve 8 is integrally formed on the top of the movable cylinder 3 and a single air flow distribution is adapted to control the timing for their movement; therefore, the operation is simplified to reduce the cost and be more effective.

Figure 7:
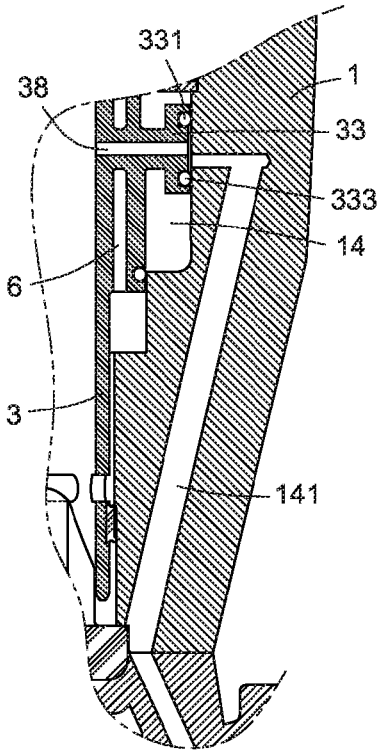
FIG. 7 is cross-sectional view of a pneumatical nail gun arranged with a nail pushing passage.
Figure 8:
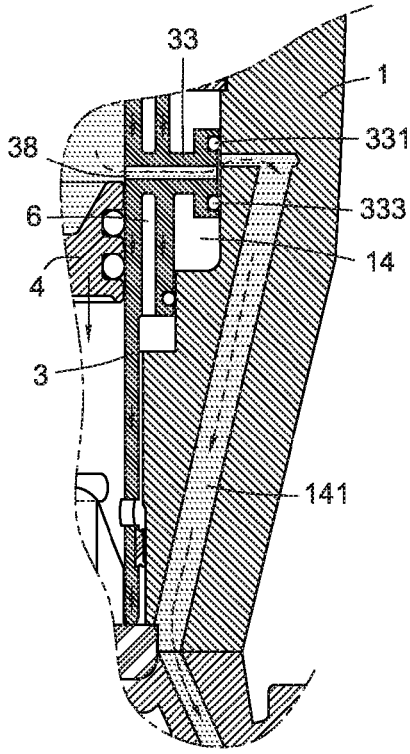
FIG. 8 is a cross-sectional view of the pneumatical nail gun of FIG. 7, showing when the piston downwardly moves to hit nail, the high pressure air in the cylinder is guided into the nail pushing passage through a guiding hole.

According to the present invention, for a nail gun arranged with a nail pushing passage 14 (shown in FIG. 7) for guiding the high pressure air to drive a nail pusher in reciprocating motion to push the nails, at least two air tight ring 331 and 333 may be disposed on the outer wall of the valve ring 33. A guiding hole 38 is formed in the valve ring 33 with one end extending to the outer wall of the valve ring 31 between two air tight ring 331 and 333 and the other end extending to inside of the cylinder 3, that is the guiding hole 38 is connected between the cylinder 3 and the nail pushing passage 141. As such, when the high pressure air in the cylinder drives the piston 4 to downwardly move (shown in FIG. 8), the high pressure air is guided into the nail pushing passage 141 to drive the nail pusher to perform the reciprocating operation.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pneumatic nail gun comprising:

a gun body having a movable cylinder installed therein, a hitting piston disposed in the cylinder to divide the cylinder into a top cylinder chamber and a bottom cylinder chamber, a main air housing formed in the gun body for accumulating compressed air at a high pressure, a trigger valve being disposed at one end of the main air housing to be driven by a trigger disposed on the gun body to drive the hitting piston to downwardly move to hit nails and upwardly move to reposit;

a head valve disposed on the top of the cylinder;

a valve ring disposed on an outer wall of the cylinder so that a middle chamber is formed between the valve ring and an inner wall of the gun body to accumulate high pressure air therein, wherein before the trigger is pressed, the high pressure air pushes the cylinder to move upwardly to make the head valve close air communication between the main air housing and the top cylinder chamber, and when the trigger is pressed, the middle chamber discharges air and the cylinder moves downwardly driven by the high pressure air in the main air housing to make the head valve open the air communication between the main air housing and the top cylinder chamber so as to guide the high pressure air driving the piston to downwardly move to hit nails; and a return passage formed on the outer wall of the cylinder to drive the piston to upwardly move for reposition, which is connected between the main air housing and the bottom cylinder chamber and includes a valve bolt therein, wherein when the trigger is released, the valve bolt is driven by the high pressure air to open the return valve opening so that the high pressure air in the main air housing is guided to the bottom cylinder chamber to continuously drive the piston to rapidly move upwardly for reposition.

2. The pneumatic nail gun as claimed in claim 1, wherein the head valve includes a main valve opening and an air tight ring disposed thereon, a rib wall being formed in the gun body; wherein before the cylinder downwardly moves, the air tight ring is closely attached on the annular rib wall to close the air communication between the main air housing and the top cylinder chamber via the main valve opening, and when the cylinder downwardly moves, the air tight ring is away from the annular rib wall to open the air communication via the main valve opening.

3. The pneumatic nail gun as claimed in claim 1, wherein an annular rib is formed inside the head valve at a top surface, and the gun body has a buffer pad disposed in the top portion and a top exhausting hole formed on the top surface for connecting with atmosphere; wherein before the cylinder downwardly moves, the annular rib opens air communication through the top exhausting hole for discharging the high pressure air in the top cylinder chamber, and when the cylinder downwardly moves, the annular rib contacts the buffer pad to close the air communication through the top exhausting hole.

4. The pneumatic nail gun as claimed in claim 1, wherein a spring is disposed in the middle chamber to assist the high pressure air in the middle chamber for pushing the cylinder, and a pushing force of the spring is less than that of the high pressure air in the main air housing to drive the cylinder to move downwardly.

5. The pneumatic nail gun as claimed in claim 1, wherein the valve bolt divides the return passage into a top passage, a middle valve chamber, and a bottom passage, the top passage is connected with the main air housing via a top through hole formed beside the cylinder for guiding the high pressure air into the top passage for accumulation, the middle valve chamber is connected with the main air housing via a bottom through hole beside the cylinder for guiding the high pressure air into the middle valve chamber for accumulation, the middle valve chamber is connected with the bottom passage via a return valve opening, and the valve bolt controls the return valve opening to open and close.

6. The pneumatic nail gun as claimed in claim 5, wherein the cylinder further includes at least one ear portion, the ear portion includes an ear hole, the return passage is at least disposed in the ear hole, and the bottom through hole is disposed on the ear portion.

7. The pneumatic nail gun as claimed in claim 5, wherein the cylinder further includes at least one ear portion, the ear portion includes an ear hole, the return passage is at least disposed in the ear hole, an annular cover is covered on the top of the ear portion, the top passage is formed in an area surrounded between in the ear hole at the top of the valve bolt and the annular cover, the top through hole is disposed on the annular cover or the ear portion, and the bottom through hole is disposed on the ear portion.

8. The pneumatic nail gun as claimed in claim 5, wherein a spring is disposed in the top passage to assist the high pressure air in the top passage pushing the valve bolt and a for pushing force of the spring is less than that of the high pressure air in the middle chamber to drive the valve bolt to move upwardly to open the return valve opening.

9. The pneumatic nail gun as claimed in claim 5, wherein the bottom passage connects to the bottom cylinder chamber via at least one bottom valve hole formed on the cylinder.

10. The pneumatic nail gun as claimed in claim 9, wherein an air tight ring is disposed on the outer wall of the cylinder near the bottom valve hole and a bottom exhausting hole formed in the gun body is for connecting to atmosphere, the air tight ring closes air communication from the bottom cylinder chamber to the bottom exhausting hole through the bottom valve hole before the cylinder moves downwardly, and the high pressure air in the bottom cylinder chamber is discharged after the cylinder moves downwardly to open the air communication.

11. The pneumatic nail gun as claimed in claim 9, wherein the bottom passage connects to the bottom valve hole via a lower chamber formed between the inner wall of the gun body and the outer wall of the cylinder.

12. The pneumatic nail gun as claimed in claim 11, wherein a spring is disposed in the lower chamber to assist moving cylinder upwardly, and a pushing force of the spring is less than that of the high pressure air in the main air housing to drive the cylinder move downwardly.

13. The pneumatic nail gun as claimed in claim 1, wherein the cylinder further includes at least one ear portion, an annular cover is covered on a top of the ear portion, the annular cover has a first push surface with a first area exposed in the main air housing, the valve ring has a second push surface with a second area exposed in the middle chamber, and the first area is smaller than the second area.

14. The pneumatic nail gun as claimed in claim 13, wherein the valve bolt has a third push surface with a third area exposed in the top passage and a fourth push surface with a fourth area exposed in the middle valve chamber, and the third area is larger than the fourth area.

15. The pneumatic nail gun as claimed in claim 1, wherein the cylinder further includes at least one top valve hole connecting with the top passage, and the piston opens and closes the top valve hole to control air communication to the top cylinder chamber.

16. The pneumatic nail gun as claimed in claim 1, wherein the cylinder further includes at least one top valve hole connecting with the top passage via a top passage formed at a top of the valve bolt in the return passage and a top through hole formed on a side of the top passage, and the piston opens and closes the top valve hole to control air communication to the top cylinder chamber.

17. The pneumatic nail gun as claimed in claim 1, wherein a guiding hole is formed in the valve ring on the outer wall of the cylinder, a nail pushing passage is formed in the gun body, and the guiding hole is connected between the cylinder and the gun body.

* * * * *